US009816763B2

(12) United States Patent
Blomgren

(10) Patent No.: US 9,816,763 B2
(45) Date of Patent: Nov. 14, 2017

(54) HEAT TRANSFER PLATE AND PLATE HEAT EXCHANGER COMPRISING SUCH A HEAT TRANSFER PLATE

(71) Applicant: ALFA LAVAL CORPORATE AB, Lund (SE)

(72) Inventor: Fredrik Blomgren, Malmö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 15/319,600

(22) PCT Filed: May 21, 2015

(86) PCT No.: PCT/EP2015/061245
§ 371 (c)(1),
(2) Date: Dec. 16, 2016

(87) PCT Pub. No.: WO2015/193057
PCT Pub. Date: Dec. 23, 2015

(65) Prior Publication Data

US 2017/0131041 A1 May 11, 2017

(30) Foreign Application Priority Data

Jun. 18, 2014 (EP) ..... 14172928

(51) Int. Cl.
*F28F 3/08* (2006.01)
*F28F 3/04* (2006.01)
(Continued)

(52) U.S. Cl.
CPC ..... *F28F 3/046* (2013.01); *F28D 9/005* (2013.01); *F28F 3/08* (2013.01); *F28F 9/0265* (2013.01); *F28F 2210/10* (2013.01)

(58) Field of Classification Search
CPC ..... F28F 3/00; F28F 3/04; F28F 3/042; F28F 3/046; F28F 3/08; F28F 9/00; F28F 9/02;
(Continued)

(56) References Cited

U.S. PATENT DOCUMENTS 3,042,382 A * 7/1962 Hryniszak ..... F28D 9/0075 165/167
4,434,643 A 3/1984 Almqvist et al.
(Continued)

FOREIGN PATENT DOCUMENTS

EP 1 070 928 A1 1/2001
GB 1 339 542 12/1973
(Continued)

OTHER PUBLICATIONS

International Search Report (PCT/ISA/210) dated Aug. 19, 2015, by the European Patent Office as the International Searching Authority for International Application No. PCT/EP2015/061245.
(Continued)

*Primary Examiner* — Len Tran
*Assistant Examiner* — Gustavo Hincapie Serna
(74) *Attorney, Agent, or Firm* — Buchanan Ingersoll & Rooney PC

(57) ABSTRACT

A heat transfer plate has first and second long sides, with a transition area adjoining the distribution area along a first borderline and adjoining a heat transfer area along a second borderline. The transition area includes a transition pattern comprising transition projections and depressions, and first, second and third sub-areas successively arranged between the first/second border lines. An imaginary straight line extends between two end points of each transition projection with a smallest angle $\alpha_n$, n=1, 2, 3 . . . relative to a longitudinal center axis of the plate. The smallest angle varies between transition projections within the second
(Continued)

sub-area such that the smallest angle for at least a main part of the transition projections within the second sub-area is larger than the first angle $\alpha_1$, and the smallest angle for a main part of the transition projections within the first sub-area is essentially equal to the first angle.

11 Claims, 7 Drawing Sheets

(51) Int. Cl.
*F28D 9/00* (2006.01)
*F28F 9/02* (2006.01)

(58) Field of Classification Search
CPC ..... F28F 9/0265; F28F 2210/10; F28D 9/00; F28D 9/005; F28D 9/0068
USPC ..... 165/165, 166, 167
See application file for complete search history.

(56) References Cited

U.S. PATENT DOCUMENTS 4,635,714 A * 1/1987 Almqvist ..... F28F 3/10 165/167
5,226,474 A * 7/1993 Hallgren ..... B01D 1/221 165/110
5,531,269 A * 7/1996 Dahlgren ..... F28D 9/005 165/167
5,727,620 A * 3/1998 Schaufele ..... F28F 3/10 165/166
6,062,305 A * 5/2000 Persson ..... F28F 3/083 165/167
6,389,696 B1 * 5/2002 Heil ..... F28D 9/005 165/139
6,394,178 B1 5/2002 Yoshida et al.
6,702,005 B1 * 3/2004 Blomgren ..... F28D 9/005 165/166
7,490,660 B2 * 2/2009 Song ..... F28F 3/10 165/166
8,028,410 B2 * 10/2011 Thompson ..... F28D 9/0043 165/167
2001/0030043 A1 * 10/2001 Gleisle ..... B23K 1/0012 165/167
2004/0069473 A1 * 4/2004 Blomgren ..... F28D 9/005 165/167
2004/0168793 A1 * 9/2004 Blomgren ..... F28D 9/005 165/167
2007/0000654 A1 * 1/2007 Matsuzaki ..... F28F 3/04 165/167
2007/0029077 A1 * 2/2007 Mirolli ..... F28D 9/005 165/167
2008/0210414 A1 9/2008 Blomgren et al.
2011/0011571 A1 * 1/2011 Schenker ..... F28D 9/005 165/167
2011/0139419 A1 * 6/2011 Blomgren ..... F28D 9/005 165/170
2012/0325434 A1 * 12/2012 Blomgren ..... F28F 3/046 165/104.19
2015/0276319 A1 10/2015 Hedberg et al.

FOREIGN PATENT DOCUMENTS

JP 7-260386 A 10/1995
JP 8-271172 A 10/1996
JP 8-271173 A 10/1996
JP 9-089482 A 4/1997
JP 2001-099583 A 4/2001
WO WO 2014/067757 A1 5/2014

OTHER PUBLICATIONS

Written Opinion (PCT/ISA/237) dated Aug. 19, 2015, by the European Patent Office as the International Searching Authority for International Application No. PCT/EP2015/061245.

* cited by examiner

HEAT TRANSFER PLATE AND PLATE HEAT EXCHANGER COMPRISING SUCH A HEAT TRANSFER PLATE

TECHNICAL FIELD

The invention relates to a heat transfer plate and its design. The invention also relates to a plate heat exchanger comprising such a heat transfer plate.

BACKGROUND ART

Plate heat exchangers, PHEs, typically consist of two end plates in between which a number of heat transfer plates are arranged in an aligned manner, i.e. in a stack or pack. Parallel flow channels are formed between the heat transfer plates, one channel between each pair of heat transfer plates. Two fluids of initially different temperatures can flow through every second channel for transferring heat from one fluid to the other, which fluids enter and exit the channels through inlet and outlet port holes in the heat transfer plates.

Typically, a heat transfer plate comprises two end areas and an intermediate heat transfer area. The end areas comprise the inlet and outlet port holes and a distribution area pressed with a distribution pattern of projections and depressions, such as ridges and valleys, in relation to a reference plane of the heat transfer plate. Similarly, the heat transfer area is pressed with a heat transfer pattern of projections and depressions, such as ridges and valleys, in relation to said reference plane. The ridges and valleys of the distribution and heat transfer patterns of one heat transfer plate are arranged to contact, in contact areas, an upper and a lower adjacent heat transfer plate, respectively, within their respective distribution and heat transfer areas.

The main task of the distribution area of the heat transfer plates is to spread a fluid entering the channel across a width of the heat transfer plate before the fluid reaches the heat transfer area, and to collect the fluid and guide it out of the channel after it has passed the heat transfer area. On the contrary, the main task of the heat transfer area is heat transfer. Since the distribution area and the heat transfer area have different main tasks, the distribution pattern normally differs from the heat transfer pattern. The distribution pattern is such that it offers a relatively weak flow resistance and low pressure drop which is typically associated with a more "open" distribution pattern design, such as a so-called chocolate pattern, offering relatively few, but large, contact areas between adjacent heat transfer plates. The heat transfer pattern is such that it offers a relatively strong flow resistance and high pressure drop which is typically associated with a more "dense" heat transfer pattern design, such as a so-called herringbone pattern, offering more, but smaller, contact areas between adjacent heat transfer plates.

The locations and density of the contact areas between two adjacent heat transfer plates are dependent, not only on the distance between, but also on the direction of, the ridges and the valleys of both heat transfer plates. As an example, if the two heat transfer plates contain similar but mirror inverted patterns of straight, equidistant ridges and valleys, as is illustrated in FIG. 1*a* where the solid lines correspond to ridges of the lower heat transfer plate and the dashed lines correspond to valleys of the upper heat transfer plate, which ridges and valleys are arranged to contact each other, then the contact areas between the heat transfer plates (cross points) will be located on imaginary equidistant straight lines (dashed-dotted) which are perpendicular to a longitudinal center axis L of the heat transfer plates. On the contrary, as is illustrated in FIG. 1*b*, if the ridges of the lower heat transfer plate are less "steep" than the valleys of the upper heat transfer plate, the contact areas between the heat transfer plates will instead be located on imaginary equidistant straight lines which are not perpendicular to the longitudinal center axis. As another example, a smaller distance between the ridges and valleys corresponds to more contact areas. As a final example, illustrated in FIG. 1*c*, "steeper" ridges and valleys correspond to a larger distance between the imaginary equidistant straight lines and a smaller distance between the contact areas arranged on the same imaginary equidistant straight line.

At the transition between the distribution area and the heat transfer area, i.e. where the plate pattern changes, the strength of a pack of heat transfer plate may be somewhat reduced as compared to the strength of the rest of the plate pack due to an uneven distribution of contact areas. The more scattered the contact areas are at the transition, the worse the strength may be, since the contact areas locally may be far apart which may result in high loads in individual contact areas. Consequently, plate packs of heat transfer plates with similar but mirror inverted patterns of steep, densely arranged ridges and valleys are typically stronger at the transition than plate packs of heat transfer plates with differing patterns of less steep, less densely arranged ridges and valleys.

A plate heat exchanger may comprise one or more different types of heat transfer plates depending on its application. Typically, the difference between the heat transfer plate types lies in the design of their heat transfer areas, the rest of the heat transfer plates being essentially similar. As an example, there may be two different types of heat transfer plates, one with a "steep" heat transfer pattern, a so-called low-theta pattern, which is typically associated with a relatively low heat transfer capacity, and one with a less "steep" heat transfer pattern, a so-called high-theta pattern, which is typically associated with a relatively high heat transfer capacity. A plate pack containing only low-theta heat transfer plates may be relatively strong since it is associated with a relatively large number of contact areas arranged at the same distance from the transition between the distribution and heat transfer areas (for illustration compare with a transition between an area according to FIG. 1*a* and an area according to FIG. 1*c*). On the other hand, a plate pack containing alternately arranged high-theta and low-theta heat transfer plates may be relatively weak since it is associated with a smaller number of contact areas arranged at the same distance from the transition (for illustration compare with a transition between an area according to FIG. 1*a* and an area according to FIG. 1*b*).

A solution to the above problem is presented in applicant's own patent application WO 2014/067757, the content of which is hereby incorporated herein by reference. With reference to FIGS. 2*a* and 2*b*, which are taken from WO 2014/067757, the solution involves the provision of a transition area 2 between a distribution area 4 and a heat transfer area 6 of a heat transfer plate 8 irrespective of plate type, i.e. what a heat transfer area pattern looks like. Thereby, a transition to the distribution area will be the same irrespective of which types of heat transfer plates a plate pack contains. FIG. 2*a* illustrates a part of the heat transfer plate 8 as such, while FIG. 2*b* contains an enlargement of a portion C of the plate part of FIG. 2*a* and schematically illustrates the contact between the heat transfer plate 8 and an adjacent heat transfer plate.

The transition area 2 is provided with a so called herringbone pattern of ridges 10 and valleys (not illustrated). The ridges 10 are arranged to contact, in contact areas, the valleys of a similar but mirror inverted transition area of said adjacent heat transfer plate. The pattern within the transition area 2 is such that the ridges 10 and valleys are steep and densely arranged. As previously mentioned, more densely, steeper patterns may typically be associated with more closely arranged contact areas across a width of the heat transfer plate. Further, the slope of the ridges 10 and valleys within the transition area 2 is varying such that the ridges and valleys become less steep in a direction from one long side 12 to another other long side 14 of the heat transfer plate 8. In that the ridges 10 and valleys "diverge" like this, the transition area 2 contributes considerably more to an even fluid distribution across a width of the heat transfer plate than it would have done if the ridges and valleys instead had been equally steep.

The transition area 2 is bow shaped. More particularly, a borderline 16 between the transition area 2 and the distribution area 4 is, seen from the heat transfer area 6, convex and extends such that a maximum number of contact areas 18 within the distribution area 4 is arranged at the same distance from the borderline 16, and a maximum number of contact areas 20 within the transition area 2 is arranged at the same distance from the borderline 16. This makes a plate pack containing the heat transfer plate 8 relatively strong at the transition between the transition area 2 and the distribution area 4. Moreover, a borderline 22 between the transition area 2 and the heat transfer area 6 is also convex seen from the heat transfer area. It has an extension similar to a borderline (not illustrated) between two transverse sub areas of the heat transfer area to enable manufacture of heat transfer plates of different sizes containing different numbers of heat transfer sub areas by use of a modular tool. As is clear from FIG. 2*b*, few contact areas 24 of the heat transfer area 6 are arranged at the same distance from the borderline 22, and few contact areas 20 within the transition area 2 are arranged at the same distance from the borderline 22. This might make the plate pack relatively weak at the transition between the transition area 2 and the heat transfer area 6.

SUMMARY

An object of the present invention is to provide a heat transfer plate which enables the creation of a plate pack which is stronger at the transition to the heat transfer area as compared to prior art. The basic concept of the invention is to increase the number of contact areas arranged at the same distance from a borderline between the transition and heat transfer areas of the heat transfer plate by a suitable extension of the borderline and a suitable pattern within the transition area. Thereby, in a plate pack containing the heat transfer plate, a more even load distribution may be achieved at the transition, which improves the strength of the plate pack. Another object of the present invention is to provide a plate heat exchanger comprising such a heat transfer plate. The heat transfer plate and the plate heat exchanger for achieving the objects above are defined in the appended claims and discussed below.

It should be stressed that the term "contact area" is used herein both for the areas of a single heat transfer plate within which the heat transfer plate is arranged to contact an adjacent heat transfer plate and the areas of mutual actual engagement between two adjacent heat transfer plates.

A heat transfer plate according to the invention has a central extension plane and a first and second long side. It comprises a distribution area, a transition area and a heat transfer area arranged in succession along a longitudinal center axis of the heat transfer plate. The transition area adjoins the distribution area along a first borderline and the heat transfer area along a second borderline. The heat transfer area, the distribution area and the transition area are provided with a heat transfer pattern, a distribution pattern and a transition pattern, respectively. The transition pattern differs from the distribution pattern and the heat transfer pattern and comprises transition projections and transition depressions in relation to the central extension plane. The transition area comprises a first sub area, a second sub area and a third sub area arranged in succession between the first and second border lines. The first, second and third sub areas adjoin each other along fifth and sixth borderlines, respectively, extending between and along adjacent ones of the transition projections. The first sub area is closest to the first long side while the third sub area is closest to the second long side. An imaginary straight line extends between two end points of each transition projection with a smallest angle $\alpha_n$, n=1, 2, 3 . . . in relation to the longitudinal center axis. The smallest angle $\alpha_n$ for at least a main part of the transition projections within the first sub area is essentially equal to a first angle $\alpha_1$. Within the second sub area the smallest angle $\alpha_n$ is varying between the transition projections such that the smallest angle $\alpha_n$ for at least a main part of the transition projections within the second sub area is larger than said first angle $\alpha_1$ and increasing in a direction from the first long side to the second long side. The heat transfer plate is characterized in that at least a main part of the second borderline is straight and essentially perpendicular to the longitudinal center axis of the heat transfer plate. Further, the smallest angle $\alpha_n$ for a first set of the transition projections within the third sub area is essentially equal to said first angle $\alpha_1$. The fifth borderline between the first and second sub areas is located, seen from the first long side of the heat transfer plate, just before the first two successive transition projections within the transition area that both are associated with a smallest angle $\alpha_n$ larger than the above referenced first angle $\alpha_1$. Further, the sixth borderline between the second and the third sub areas is located, seen from the fifth borderline, just before the first two successive transition projections within the transition area that both are associated with a smallest angle $\alpha_n$ equal to the first angle $\alpha_1$.

The fact that the fifth and sixth borderlines extend between and along adjacent ones of the transition projections means that each of the transition projections, in its entirety, will be located within one specific sub area.

In the case of a straight transition projection, the corresponding imaginary straight line will extend along the complete transition projection. This will not be the case for a non-straight transition projection.

All the transition projections within the second sub area may be associated with different angles, or some, but not all, of the transition projections may be associated with the same angle.

The transition area of the heat transfer plate may be arranged to contact a transition area of an adjacent heat transfer plate provided with a similar but mirror inverted pattern. Then, the first, second and third sub areas of one transition area will contact at least the third, second and first sub areas, respectively, of the other transition area. The exact interface between the two transition areas is dependent upon the locations and extensions of the fifth and sixth borderlines.

In that at least a main part of the second borderline is straight and essentially perpendicular to the longitudinal center axis of the heat transfer plate, a relatively large number of contact areas within the heat transfer area arranged at the same distance from the second borderline, may be obtained, particularly if the heat transfer plate is arranged to contact another heat transfer plate according to the invention provided with the same heat transfer pattern, mirror-inverted.

In that both the first and the third sub areas comprises transition projections having a smallest angle equal to said first angle $\alpha_1$, a relatively large number of contact areas of the first and third sub areas of the transition area arranged at the same distance from the second borderline, may be obtained. This is irrespective of whether the heat transfer plate is arranged to contact another heat transfer plate according to the invention provided with the same heat transfer pattern or a different one.

The heat transfer plate may be such that at least a main part of the transition projections of said first set of transition projections within the third sub area extends from the second borderline. Thereby, a relatively large number of contact areas of the third sub area of the transition area close to, or even essentially on, the second borderline, may be obtained. This enables an optimization of the strength, at the transition to the heat transfer area, of a plate pack containing the heat transfer plate.

The heat transfer plate may be so designed that the smallest angle $\alpha_n$ for a second set of the transition projections within the third sub area is larger than said first angle $\alpha_1$. This may contribute to the guiding of fluid towards the second long side of the heat transfer plate, which in turn results in a more even fluid distribution across a width of the heat transfer plate. Further, at least a main part of the transition projections of said second set may extend from the first borderline. Thereby, a relatively large number of contact areas of the third sub area of the transition area close to, or even essentially on, the first borderline, may be obtained. This enables an optimization of the strength, at the transition to the distribution area, of a plate pack containing the heat transfer plate.

Each of at least a main part of the transition projections within the third sub area extending from the second borderline may be connected to a respective one of the transition projections within the third sub area extending from the first borderline. Thereby, continuous ridges extending from the first to the second borderline may be obtained which in turn enables a controlled guidance of fluid through the transition area. One or more projections extending from the second borderline may be connected to one and the same projection extending from the first borderline so as to form a "mono ridge" or a branched ridge. Further, the ridges could be integrally formed.

The design of the transition area of the heat transfer plate may be such that a shortest distance between the imaginary straight lines of two adjacent, along each other extending, transition projections within the third sub area is essentially constant within a main portion of the third sub area. Thereby, a relatively large number of evenly spaced contact areas of the third sub area of the transition area arranged at the same distance from the second borderline, may be obtained.

The heat transfer area may border on the third sub area of the transition area along 10-40% of the second border line. Such an interval enables a heat transfer plate having a relatively large number of contact areas of the third sub area of the transition area at the same distance from the second borderline but still has a relatively narrow transition area, i.e. a relatively large heat transfer area. A shorter border between the heat transfer area and the third sub area is typically associated with a smaller number of contact areas and a more narrow transition area, and vice versa.

A center portion of the first borderline may be arched and convex as seen from the heat transfer area such that the center portion of the first borderline coincides with a contour of an imaginary oval. Further, the first borderline may deviate from the contour of the imaginary oval outside the center portion. In that the first borderline does not have to be convex throughout, the extension of the distribution area adjacent the second long side of the heat transfer plate may be such as to contribute to the guiding of fluid towards the second long side of the heat transfer plate, as will be further discussed below. In turn, this results in a more even fluid distribution across the width of the heat transfer plate.

A second outer portion of the first borderline, which extends from the center portion of the first borderline towards the second long side of the heat transfer plate, may extend towards the second borderline. This may mean that a distal end point of the second outer portion of the first borderline is closer to the second borderline than an end point of the same connected to the center portion of the same. In turn, this may involve an increased extension of the distribution area adjacent the second long side of the heat transfer plate which may prolong a "residence time", within the distribution area, of a fluid.

Further, the second outer portion of the first borderline may extend at a distance from, and essentially parallel to, a fourth borderline delimiting the distribution area. This may result in a relatively even distribution of contact areas between the second outer portion of the first borderline and the fourth borderline.

The center portion of the first borderline may occupy 40-90% of the width of the heat transfer plate, which interval enables an optimization as regards an even fluid distribution across the plate width.

The plate heat exchanger according to the present invention comprises a heat transfer plate as described above.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1A:
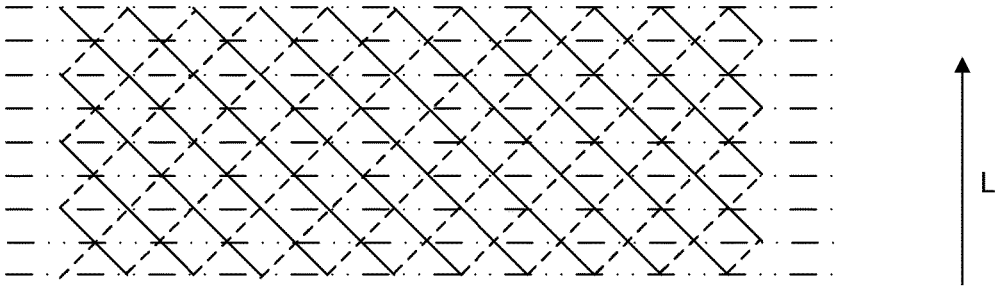
FIGS. 1*a*-1*c* illustrate contact areas between different pairs of heat transfer plate patterns.
Figure 1B:
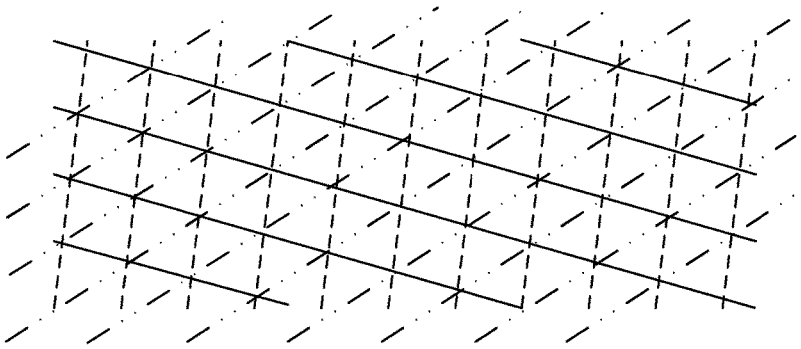
Figure 1C:
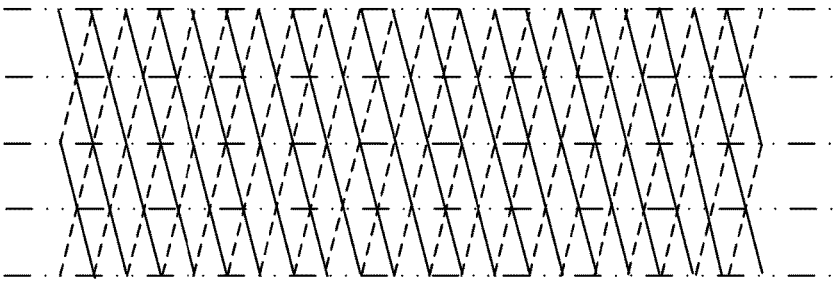
Figure 2A:
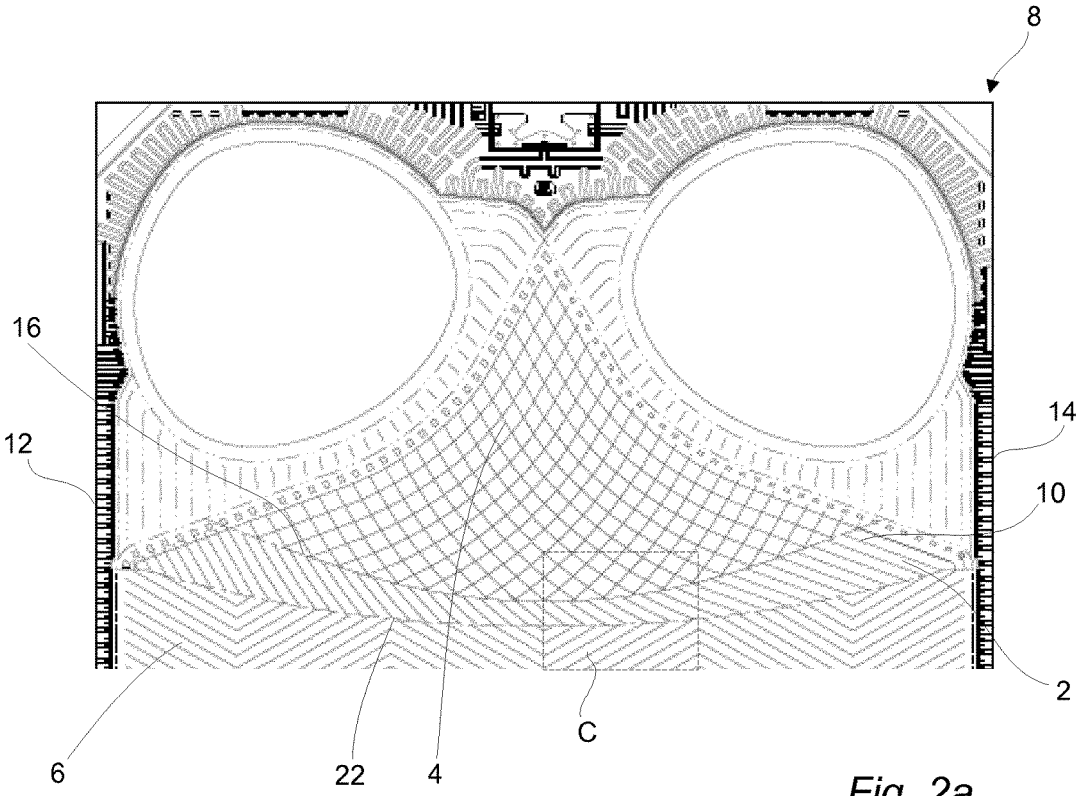
FIGS. 2*a*-2*b* are plan views of a heat transfer plate according to prior art.
Figure 2B:
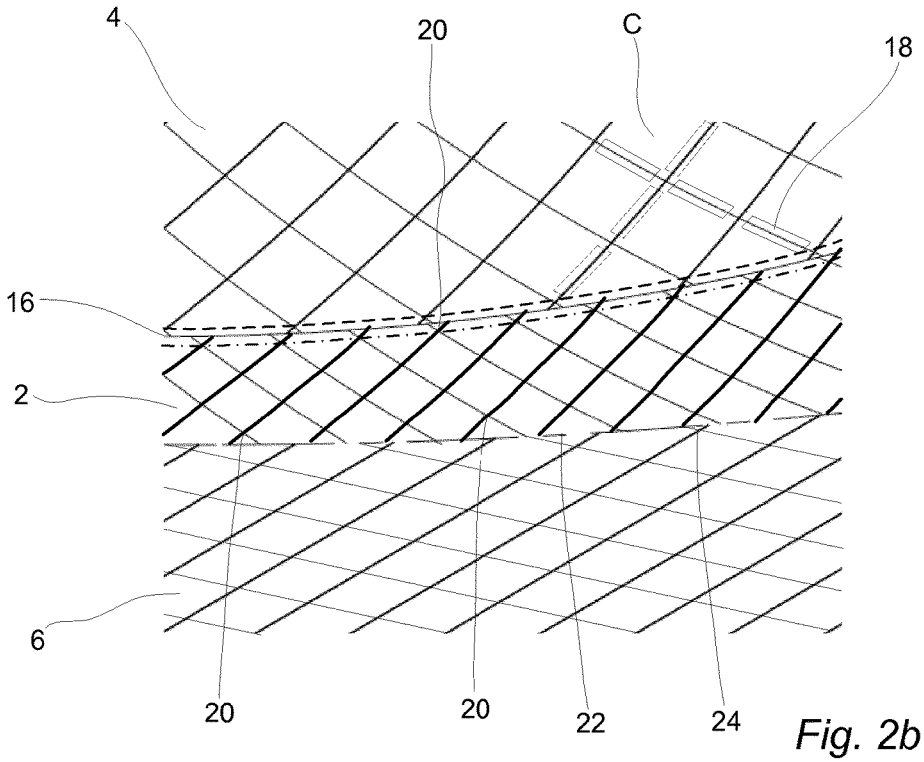
Figure 3:
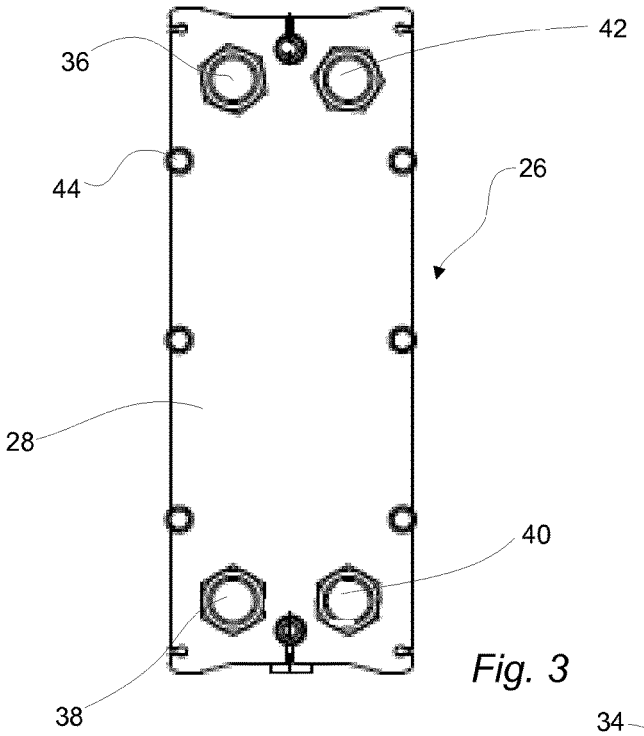
FIG. 3 is a front view of a plate heat exchanger according to the invention.
Figure 4:
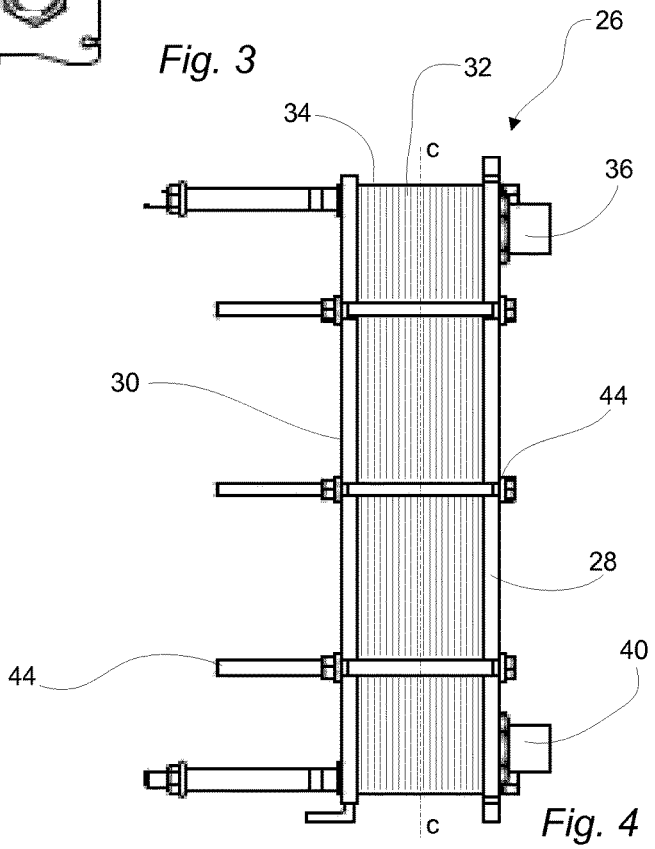
FIG. 4 is a side view of the plate heat exchanger of FIG. 3.

With reference to FIGS. 3 and 4, a semi-welded plate heat exchanger 26 is shown. It comprises a first end plate 28, a second end plate 30 and a number of heat transfer plates arranged between the first and second end plates 28 and 30, respectively. The heat transfer plates are all of the same type. One of them is denoted 32 and illustrated in further detail in FIG. 5. The heat transfer plates are arranged in a plate pack 34 with a front side (illustrated in FIG. 5) of one heat transfer plate facing a front side of a first neighboring heat transfer plate and a back side (not illustrated) of said one plate facing a back side of a second neighboring heat transfer plate by rotating said first and second neighboring plates 180 degrees around a horizontal center axis x.

The heat transfer plates are welded together in pairs to form cassettes, which cassettes are separated from each other by gaskets (not shown). The heat transfer plates together with the gaskets and welds form parallel channels arranged to receive two fluids for transferring heat from one fluid to the other. To this end, a first fluid is arranged to flow in every second channel and a second fluid is arranged to flow in the remaining channels. The first fluid enters and exits the plate heat exchanger 26 through inlet 36 and outlet 38, respectively. Similarly, the second fluid enters and exits the plate heat exchanger 26 through inlet 40 and outlet 42, respectively. For the plate pack 34 to be leak proof, the heat transfer plates must be pressed against each other whereby the gaskets seal between the heat transfer plates. To this end, the plate heat exchanger 26 comprises a number of tightening means 44 arranged to press the first and second end plates 28 and 30, respectively, towards each other.

The design and function of semi-welded plate heat exchangers are well-known and will not be described in detail herein.

The heat transfer plate 32 will now be further described with reference to FIGS. 5, 6 and 7 which illustrate the complete heat transfer plate, a part A of the heat transfer plate and a portion C of the heat transfer plate part A, respectively, and FIGS. 8, 9, 10 and 11 which illustrate cross sections of projections and depressions of the heat transfer plate.

The heat transfer plate 32 is an essentially rectangular sheet of stainless steel. It has a central extension plane c-c (see FIG. 4) parallel to the figure plane of FIGS. 5, 6 and 7, and to a longitudinal center axis y of the heat transfer plate 32, and a first long side 46 and a second long side 48. The heat transfer plate 32 further comprises a first end area 50, a second end area 52 and a heat transfer area 54 arranged there between. In turn, the first end area 50 comprises an inlet port hole 56 for the first fluid and an outlet port hole 58 for the second fluid arranged for communication with the inlet 36 and the outlet 42, respectively, of the plate heat exchanger 26. Similarly, in turn, the second end area 52 comprises an inlet port hole 60 for the second fluid and an outlet port hole 62 for the first fluid arranged for communication with the inlet 40 and the outlet 38, respectively, of the plate heat exchanger 26. Hereinafter, only the first one of the first and second end areas will be described since the structures of the first and second end areas are the same but partly mirror inverted (transition areas not mirror inverted) with respect to the horizontal center axis x.

The first end area 50 comprises a distribution area 64 and a transition area 66. A first borderline 68 separates the distribution and transition areas and the transition area 66 borders on the heat transfer area 54 along a second borderline 70. Third and fourth borderlines 72 and 74, respectively, which extend from a connection point 76 to a respective first and second end point 78, 80 of the second borderline 70, via a respective first and second end point 82, 84 of the first borderline 68, delimit the distribution area 64 and the transition area 66 from the rest of the first end area 50. The third and fourth borderlines are similar but mirror inverted with respect to the longitudinal center axis y. The distribution area extends from the first borderline 68 in between the inlet and outlet port holes 56 and 58, respectively.

Figure 6:
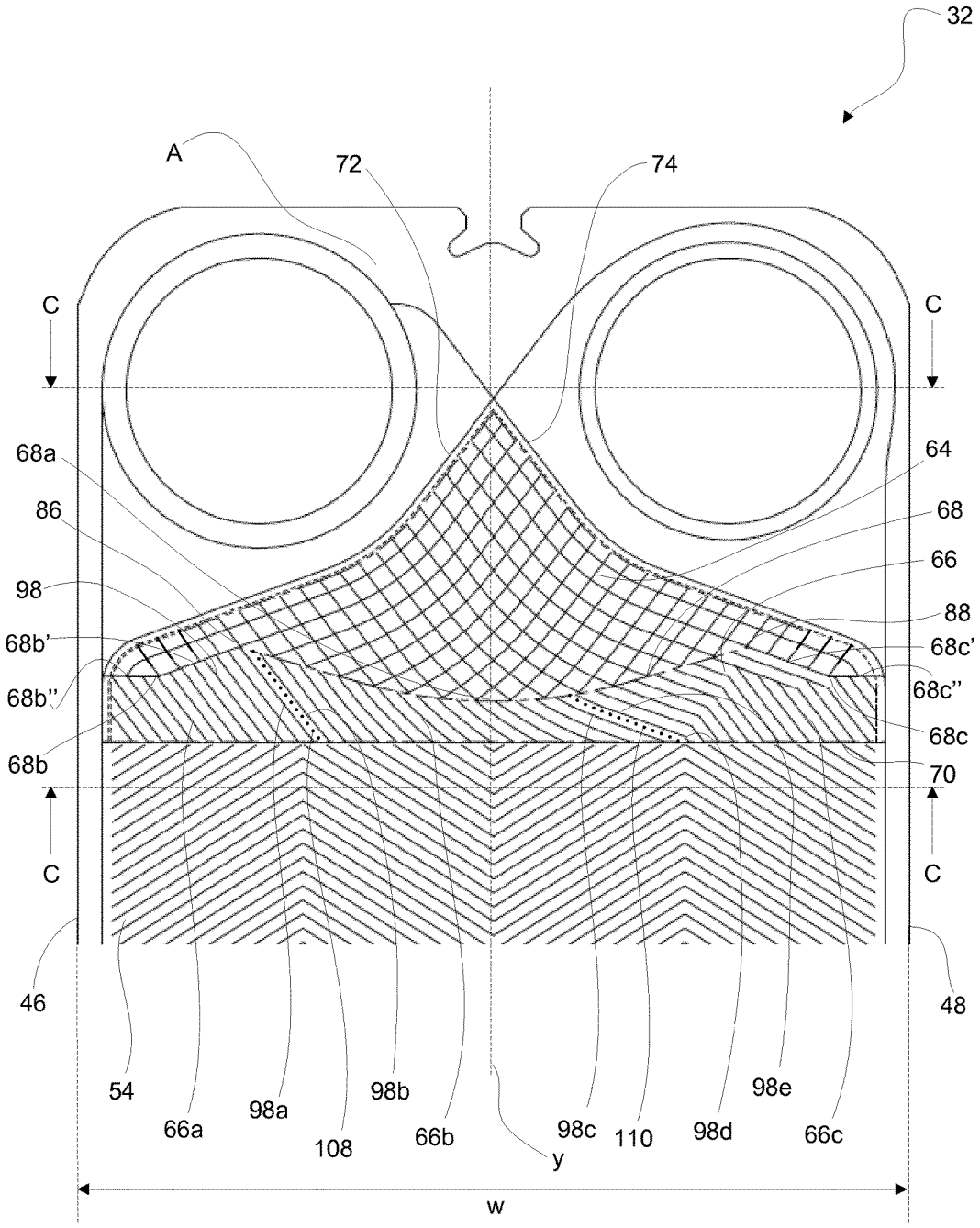
FIG. 6 is an enlargement of a part of the heat transfer plate of FIG. 5.

With reference particularly to FIG. 6, the second borderline 70 is straight and perpendicular to the longitudinal center axis y of the heat transfer plate 32. The first borderline 68 comprises a center portion 68*a* which is arched and convex as seen from the heat transfer area 54. More particularly, the center portion 68*a* coincides with a contour of an imaginary oval (not illustrated) and it occupies 62% of a width w of the heat transfer plate 32. Further, the first borderline 68 comprises a first outer portion 68*b* and a second outer portion 68*c* extending from a respective end point 86 and 88 of the center portion 68*a*. The first and second outer portions are similar but mirror-inverted with respect to the longitudinal center axis y. A respective first section 68*b*' and 68*c*' of the first and second outer line portions 68*b* and 68*c* extends towards the first and second long sides 46 and 48, respectively, and towards the second borderline 70. As is clear from the figures, the first and second line sections 68*b*' and 68*c*' extend essentially parallel to the third and fourth borderlines 72 and 74, respectively, delimiting the distribution area 64. Further, a respective second section 68*b*" and 68*c*" of the first and second outer line portions 68*b* and 68*c* extends towards the first and second long sides 46 and 48, respectively, and parallel to the second borderline 70.

Figure 7:
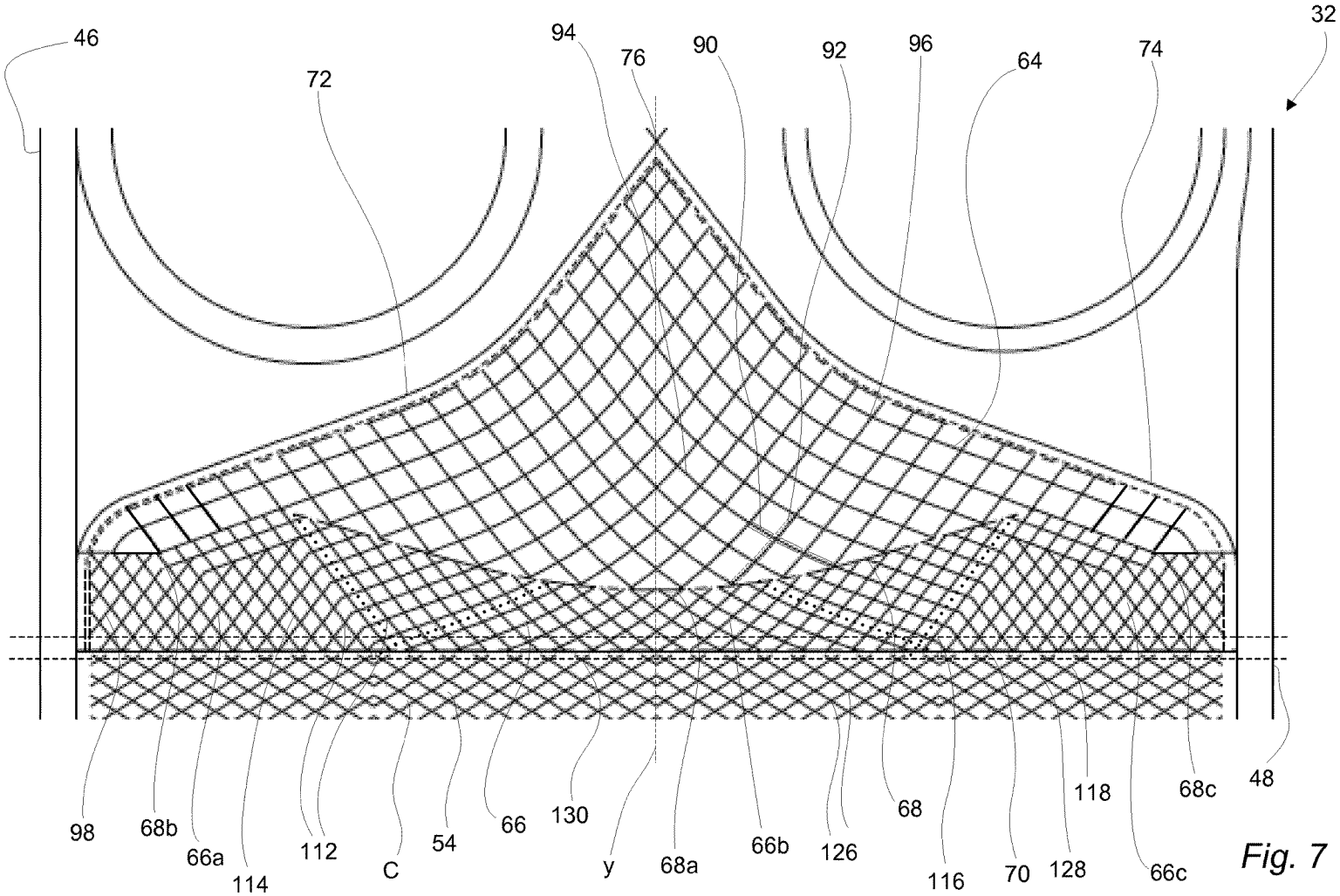
FIG. 7 is an enlargement of a portion of the heat transfer plate part of FIG. 6 and illustrates schematically contact areas of the heat transfer plate.
Figure 8:
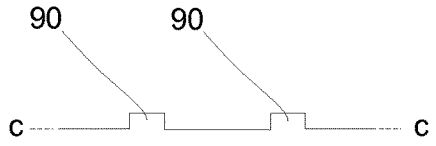
FIG. 8 is a schematic cross section of distribution projections of a distribution pattern of the heat transfer plate.
Figure 9:
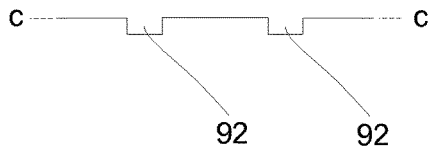
FIG. 9 is a schematic cross section of distribution depressions of the distribution pattern of the heat transfer plate.

With reference particularly to FIG. 7, the distribution area 54 is pressed with a distribution pattern of elongate distribution projections 90 (solid quadrangles) and distribution depressions 92 (dashed quadrangles) in relation to the central extension plane c-c. Only a few of these distribution projections and depressions are illustrated in the figures. The distribution projections 90 are arranged along imaginary projection lines 94 which each extends essentially parallel to a respective portion of the fourth borderline 74, which respective portion extend from the connection point 76. FIG. 8 illustrates a cross section of the distribution projections 90 taken essentially perpendicular to the respective imaginary projection lines 94. Similarly, the distribution depressions 92 are arranged along imaginary depression lines 96 which each extends essentially parallel to a respective portion of the third borderline 72, which respective portion extend from the connection point 76. FIG. 9 illustrates a cross section of the distribution depressions 92 taken essentially perpendicular to the respective imaginary depression line 96.

The distribution projections 90 of the heat transfer plate 32 are arranged to contact, along their complete extension, respective distribution projections within the second end area of an overhead heat transfer plate while the distribution depressions 92 are arranged to contact, along their complete extension, respective distribution depressions within the second end area of an underlying heat transfer plate. The distribution pattern is a so-called chocolate pattern.

As is clear from FIG. 7, the distribution projection 90 along each of the imaginary projection lines 94, and the distribution depressions 92 along each of the imaginary depression lines 96, arranged closest to the first borderline 68, are arranged near, and at essentially equal distance from, the center portion 68*a*, the first outer portion 68*b* and the second outer portion 68*c*, respectively.

Figure 5:
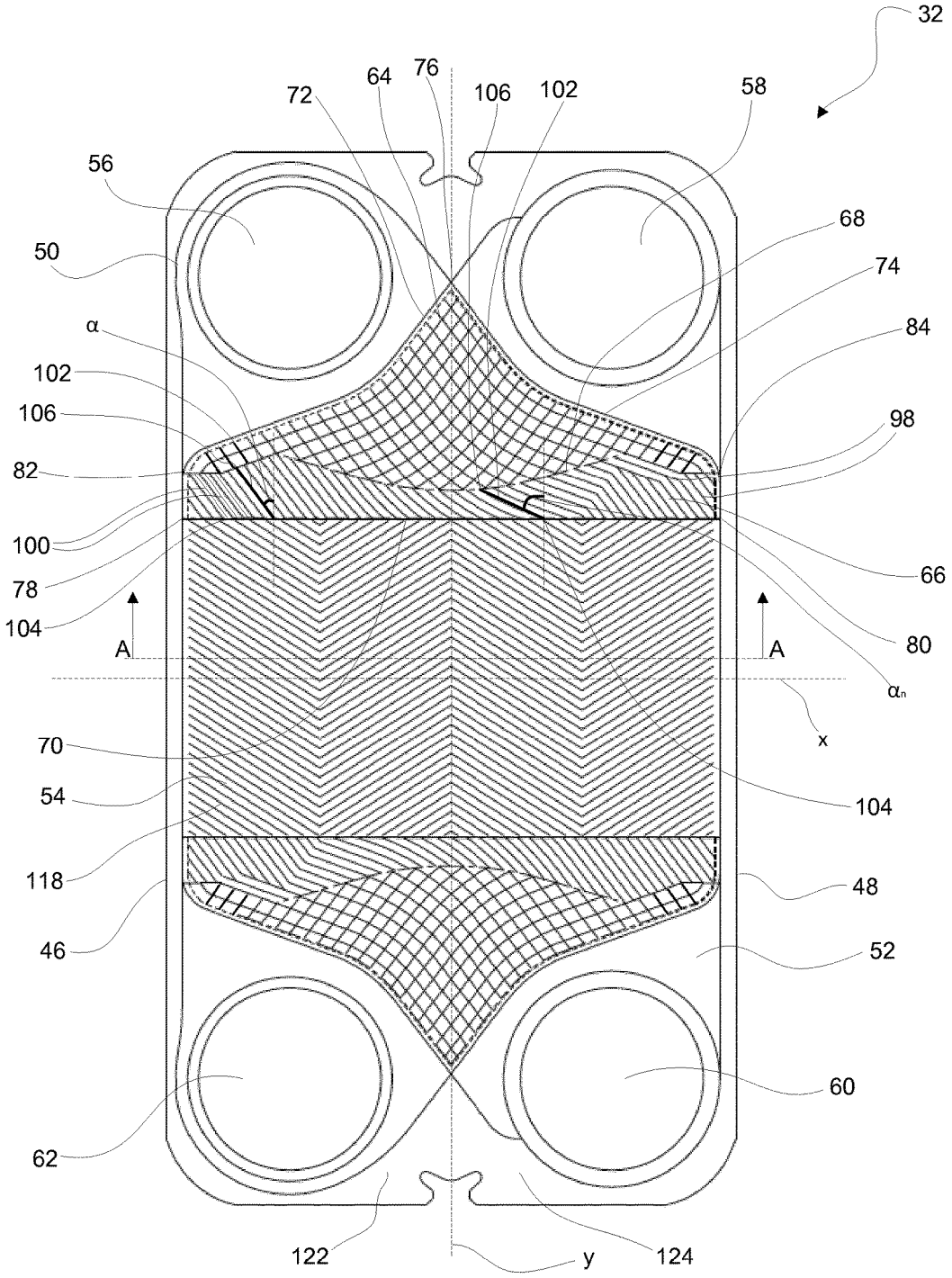
FIG. 5 is a plan view of a heat transfer plate according to the invention.
Figure 10:
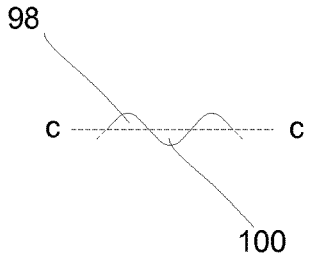
FIG. 10 is a schematic cross section of transition projections and transition depressions of a transition pattern of the heat transfer plate.

With reference to FIG. 5, the transition area 66 is pressed with a transition pattern of alternately arranged transition projections 98 and transition depressions 100 (of which only a few are illustrated) in the form of ridges and valleys, respectively, in relation to the central extension plane c-c. FIG. 10 illustrates a cross section of the transition projections 98 and the transition depressions 100 taken essentially perpendicular to their extension. In the following, the reasoning will be focused on the transition projections (due to the similarities between the transition projections and transition depressions, a corresponding reasoning focused on the transition depressions would be superfluous).

Each of the transition projections 98 extend along a line which is similar to a respective part of the fourth borderline 74, as will be further discussed below. Further, each of the transition projections 98 is associated with a smallest angle $\alpha_n$, n=1, 2, 3 . . . , measured between the longitudinal center axis y and an imaginary straight line 102, which extends between two end points 104 and 106 of each transition projection 98 (illustrated for two of the transition projections in FIG. 5). Here, the smallest angle $\alpha_n$ is measured from the imaginary straight line 102 to the longitudinal center axis y in a clockwise direction. A corresponding largest angle would here instead be measured in a counterclockwise direction.

Further, with reference to FIG. 6, the transition area 66 is divided into a first sub area 66*a*, a second sub area 66*b* and a third sub area 66*c*, the first and third sub areas being adjacent the first and second long sides 46 and 48, respectively, of the heat transfer plate 32, and the second sub area being arranged between the first and third sub areas. The first and second sub areas 66*a* and 66*b*, respectively, adjoin each other along a fifth borderline 108 extending between and along transition projections 98*a* and 98*b*, while the second and third sub areas 66*b* and 66*c*, respectively, adjoin each other along a sixth borderline 110 extending between and along transition projections 98*c*, 98*d* and 98*e*.

Each of the transition projections 98 within the first sub area 66*a* extends from the first borderline 68 to the second borderline 70 and along a line which is similar to a respective upper straight part of the fourth borderline 74. Thus, the transition projections 98 within the first sub area 66*a* are parallel and associated with the same smallest angle, a first angle $\alpha_1$.

Each of the transition projections 98 within the second sub area 66*b* extends from the first borderline 68 to the second borderline 70 and along a line which is similar to a respective intermediate curved part of the first borderline 74. The transition pattern is "divergent" within the second sub area 66*b* meaning that the transition projections 98 are non-parallel. More particularly, the smallest angle $\alpha_n$, which for all the transition projections 98 within the second sub area 66*b* is larger than the above first smallest angle $\alpha_1$, varies between the transition projections 98 and increases in a direction from the first long side 46 to a second long side 48 of the heat transfer plate 32. In other words, the transition projections 98 within the second sub area 66*b* are steeper closer to the first long side than closer to the second long side.

The third sub area 66*c* comprises a first set of transition projections which each extends from the second borderline 70 and in the same direction, and with the same mutual distance, as the transition projections 98 within the first sub area 66*a*. This means that the transition pattern is partly the same within the first and third sub areas of the transition area 66. Thus, the transition projections 98 of the first set are parallel and associated with the same smallest angle, the first angle $\alpha_1$. Further, the third sub area 66*c* comprises a second set of transition projections which each extends from the first borderline 68 and along a line which is similar to a respective lower part of the first borderline 74, which lower part has curved as well as straight portions. The transition projections 98 within the second set are non-parallel and all less steep than the transition projections within the second sub area 66*b*. The smallest angle $\alpha_n$, which for all the transition projections 98 of the second set is larger than the first smallest angle $\alpha_1$, varies between the transition projections 98 of the second set and increases in a direction from the first long side 46 to a second long side 48 of the heat transfer plate 32.

Each of the transition projections within the first set is connected to a respective one of the transition projections within the second set to form continuous ridges extending from the first to the second borderline 68 and 70, respectively. As is clear from FIG. 6, some of the first set transition projections are connected to, more particularly integrally formed with, one and the same second set transition projection resulting in a branched ridge. Further, some of the second set transition projections are connected to, more particularly integrally formed with, one first set transition projection only, resulting in "mono" ridges. A length of each of the transition projections within the third sub area 66*c* is such that a shortest distance between two adjacent, along each other extending, ones of the transition projections 98 is essentially constant within the third sub area.

The fifth borderline 108 between the first and second sub areas 66*a* and 66*b* is located, seen from the first long side 46 of the heat transfer plate 32, just before the first two successive transition projections within the transition area that both are associated with a smallest angle $\alpha_n$ larger than the above referenced first angle $\alpha_1$. Further, the sixth borderline 110 between the second and the third sub areas 66*b* and 66*c* is located, seen from the fifth borderline 108, just before the first two successive transition projections within the transition area that both are associated with a smallest angle $\alpha_n$ equal to the first angle $\alpha_1$.

As illustrated in FIG. 7, the transition projections 98 comprise essentially point shaped transition contact areas 112 arranged for engagement with respective point shaped transition contact areas of transition projections 114 within the second end area of an overhead heat transfer plate. Similarly, the transition depressions 100 (illustrated in FIGS. 5 & 10 only) comprise essentially point shaped transition contact areas arranged for engagement with respective point shaped transition contact areas of transition depressions within the second end area of an underlying heat transfer plate (not illustrated). The transition pattern is a so-called herringbone pattern.

The transition contact area 112 of each transition projection 98 arranged closest to the first borderline 68 are arranged near, and at essentially equal distance from, the center portion 68*a*, the first outer portion 68*b* and the second outer portion 68*c*, respectively, of the first borderline 68.

The heat transfer area 54 borders on the first sub area 66*a*, the second sub area 66*b* and the third sub area 66*c* along approximately 27%, 46% and 27%, respectively, of the second borderline 70. Thus, along about 54% (2×27%) of the second borderline 70 and adjacent the same, the transition pattern is similar. As described by way of introduction, similar mirror-inverted patterns of straight corrugations result in contact areas arranged on straight, equidistant lines.

As is clear from FIG. 7, the transition contact area 112 of each transition projection 98 that is closest to the second borderline 70 is arranged on an imaginary contact line 116 within the first and third sub areas 66*a* and 66*c*, respectively, of the transition area 66, which contact line 116 is parallel to the first borderline 70. (Actually, the closest transition contact areas which come last within the first sub area and first within the third sub area as seen from the first long side 46, are arranged slightly outside the contact line 116. This is a consequence of the transition projection 98*d* (see FIG. 6) being relatively short, and the effect of it is negligible.)

Further, within the second sub area 66*b* of the transition area 66, at least a few of the transition contact areas 112 that is closest to the second borderline 70 is arranged outside the imaginary contact line 116. However, the spreading of these closest transition contact areas is relatively small resulting in that the strength of the heat transfer plate, within the second sub area, still is sufficient. Naturally, if the transition projections within the second sub area 66*b* is considered to correspond to the second set of transition projections (which extend from the first borderline 68) within the third sub area 66*c*, the second sub area 66*b* could also comprise a plurality of straight parallel transition projections associated with a smallest angle $\alpha_n$ equal to the first angle $\alpha_1$ corresponding to the first set of transition projections (which extend from the second borderline 70) within the third sub area 66*c*. Then, the closest transition contact areas could be arranged on a straight line across the entire width of the plate. However, this would result in a considerably longer (length measured along the axis y) transition area at the expense of the size of heat transfer area.

Figure 11:
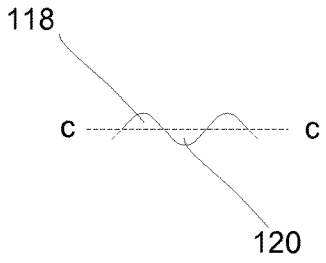
FIG. 11 is a schematic cross section of heat transfer projections and heat transfer depressions of a heat transfer pattern of the heat transfer plate.

With reference to FIGS. 5 & 11, the heat transfer area 54 is pressed with a heat transfer pattern of alternately arranged essentially straight heat transfer projections 118 and heat transfer depressions 120, in the form of ridges and valleys, respectively, in relation to the central extension plane c-c. The depressions 120 are shown only in FIG. 11 which illustrates the cross section of the heat transfer projections 118 and the heat transfer depressions 120 taken perpendicular to their extension. The heat transfer pattern within a first half 122 of the heat transfer plate and the heat transfer pattern within a second half 124 of the heat transfer plate are similar but mirror inverted with respect to the longitudinal center axis y. Further, the heat transfer projections and depressions within the first half 122, and thus also the second half 124, are parallel.

With reference to FIG. 7, the heat transfer projections 118 comprise essentially point shaped heat transfer contact areas 126 arranged for engagement with respective point shaped heat transfer contact areas of heat transfer projections 128 of an overhead heat transfer plate. Similarly, the heat transfer depressions 120 comprise essentially point shaped heat transfer contact areas arranged for engagement with respective point shaped heat transfer contact areas of heat transfer depressions of an underlying heat transfer plate (not illustrated). The heat transfer pattern is a so-called herringbone pattern.

Again, similar mirror-inverted patterns of straight corrugations result in contact areas arranged on straight, equidistant lines. Accordingly, as is clear from FIG. 7, the heat transfer contact area 126 of each heat transition projection 118 (and the heat transfer contact area of each heat transition depression 120) that is closest to the second borderline 70 is arranged on an imaginary contact line 130 which is parallel, and close to, to the first borderline 70.

As explained above, the plate heat exchanger 26 is arranged to receive two fluids for transferring heat from one fluid to the other. With reference to FIG. 5 and the heat transfer plate 32, the first fluid flows through the inlet port hole 56 to the back side (not visible) of the heat transfer plate 32, along a back side through the distribution and transition areas of the first end area, the heat transfer area and the transition and distribution areas of the second end area and back through the outlet port hole 62. Similarly, the second fluid flows through an inlet port hole of an overhead heat transfer plate, which inlet port hole is aligned with the inlet port hole 60 of the heat transfer plate 32, to the front side of the heat transfer plate 32. Then, the second fluid flows along a front side through the distribution and transition areas of the second end area, the heat transfer area and the transition and distribution areas of the first end area and back through an outlet port hole of the overhead heat transfer plate, which outlet port hole is aligned with the outlet port hole 58 of the heat transfer plate 32.

As previously mentioned, the main purpose of the distribution area is to spread fluid evenly across the width of the heat transfer plate while the main purpose of the heat transfer area is heat transfer. The main purpose of the transition area is to make the heat transfer plate relatively strong at the transition between the distribution and heat transfer areas. With the transition area according to WO 2014/067757, the contact areas of the distribution area closest to the first borderline, just like the contact areas of the transition area closest to the first borderline, are arranged at equal distance from the first borderline which is beneficial to the plate strength. However, the contact areas of the transition area closest to the second borderline, just like the contact areas of the heat transfer area closest to the second borderline, are arranged at different distances from the second borderline, which may be associated with inferior plate strength. The transition area according to the present invention offers a solution to this problem. In that the second borderline is made straight and perpendicular to a longitudinal center axis of the plate, the contact areas of the heat transfer area closest to the second borderline will be arranged at equal distance from the second borderline, at least when two heat transfer plates with (at least partly) similar heat transfer patterns are combined. Further, in that the first and third sub areas of the transition area comprises similar patterns close to the second borderline, a main part of the contact areas of the first and third transition sub areas will be arranged at equal distance from the second borderline.

To obtain similar patterns within the first and third transition sub areas, some (the first set) of the transition projections within the third sub area have been made relatively steep. Since a steep pattern is associated with a relatively low flow resistance, and a fluid tends to choose a path across the plate offering the lowest flow resistance, the distribution area has been "prolonged" towards the first and second long sides 46 and 48 of the heat transfer plate. With reference to FIG. 6, these "prolongations" consist of the distribution area sections extending between the third borderline 72 and the first outer portion 68*b* of the first borderline 68, and the fourth borderline 74 and the second outer portion 68*c* of the first borderline 68, respectively. Fluid will be guided through these "prolongations" towards the first and second long sides 46, 48 of the heat transfer plate which will decrease "leaking" of fluid into the transition area 66 close to the end point 88 of the center portion 68*a* of the first borderline 68. This improves the fluid distribution across the plate width.

The above described embodiment of the present invention should only be seen as an example. A person skilled in the art realizes that the embodiment discussed can be varied and combined in a number of ways without deviating from the inventive conception.

As an example, the above specified distribution, transition and heat transfer patterns are just exemplary. Naturally, the invention is applicable in connection with other types of patterns. For example, the transition projections need not extend along lines which are similar to respective parts of the fourth borderline. The third area may comprise more or less "branched" ridges, and these ridges may have the same or different numbers of "branches". Further, a transition projection may comprise both straight and curved portions.

The transition areas of the first and second end areas of the heat transfer plate illustrated in the drawings are similar but rotated 180 degrees around a normal of the plate in relation to each other. Naturally, this need not be the case. As an alternative, depending on how the heat transfer plate is arranged to be orientated with respect to neighboring plates in a plate pack, the transition areas of the first and second end areas of the heat transfer plate could be the same but mirror inverted with respect to the horizontal center axis x of the plate.

The first borderline extending between the transition and distribution areas need not extend according to the above. For example, the first and second outer portions of the first borderline could extend in a countless number of different ways. Further, the first borderline could be straight and parallel to the second borderline, or have another form such as a wave form or a saw tooth form.

The above described plate heat exchanger is of parallel counter flow type, i.e. the inlet and the outlet for each fluid are arranged on the same half of the plate heat exchanger and the fluids flow in opposite directions through the channels between the heat transfer plates. Naturally, the plate heat exchanger could instead be of diagonal flow type and/or a co-flow type.

The plate heat changer above comprises one plate type only. Naturally, the plate heat exchanger could instead comprise two or more different types of alternately arranged heat transfer plates. Further, the heat transfer plates could be made of other materials than stainless steel.

The present invention could be used in connection with other types of plate heat exchangers than semi-welded ones, such as all-welded, (all-)gasketed and brazed plate heat exchangers.

In the above described embodiment the second borderline is straight throughout. In alternative embodiments, parts of the second borderline could deviate from a straight extension. As an example, to prevent bending of the heat exchanger plate along the second borderline, one or more of the transition projections could be made to cross the second border line and connect to a respective one of the heat transfer projections.

In the above described embodiment, the first sub area 66*a* of the transition area 66 is arranged to contact the third sub area of an overhead transition area. Further, the second sub area 66*b* is arranged to contact both the second and the third sub areas of the overhead transition area while the third sub area 66*c* is arranged to contact both the first and the second sub areas of the overhead transition area. Naturally, the location and extension of the fifth and sixth borderlines may be different than above described in alternative embodiments which may change the interface between the transition area 66 and the overhead transition area.

In the above described embodiment, the transition projections (and transition depressions) within the first sub area have a number of common features, for example that all of them are straight and associated with the same smallest angle $\alpha_n$. These common features define the general design of the transition projections within the first sub area. Naturally, one or more of the transition projections within the first sub area could lack one (or more) of these common features, for example be associated with a different angle, as long as a main part of the transition projections have this common feature.

A reasoning corresponding to the above is valid for the transition projections within the second sub area. For example, a common feature of the transition projections of the second sub area is that they are associated with a respective smallest angle $\alpha_n$ which is increasing or constant in a direction from the first to the second long side of the heat transfer plate. Naturally, one or more of the transition projections within the second sub area could be associated with a smallest angle $\alpha_n$ that deviates from this "behavior", as long as a main part of the transition projections are not associated with such a deviation.

Naturally, a reasoning corresponding to the above is valid also for the transition projections within the third sub area.

Starting from the first long side of the heat transfer plate, if two successive transition projections both lacking a common feature of the first sub area are encountered, this could mean that these successive transition projections are arranged within the second sub area.

The individual transition projections or connected transition projections (continuous ridges within the third sub area) need not all extend all the way from the first to the second borderline.

Finally, in the above described embodiment, the first end points of the first and second borderlines, as well as the second end points of the first and second borderlines are arranged at the same distance from the respective long side. According to an alternative embodiment, the first and second end points of the first borderline could instead be arranged at a larger distance from the respective long sides than the first and second end points of the second borderline to create a transition area with a tapered width.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate having a central extension plane, a first long side and second long side and comprising a distribution area, a transition area and a heat transfer area arranged in succession along a longitudinal center axis of the heat transfer plate, the transition area adjoining the distribution area along a first borderline and the heat transfer area along a second borderline, the heat transfer area, the distribution area and the transition area being provided with a heat transfer pattern, a distribution pattern and a transition pattern, respectively, the transition pattern differing from the distribution pattern and the heat transfer pattern and comprising transition projections and transition depressions in relation to the central extension plane, the transition area comprising a first sub area, a second sub area and a third sub area arranged in succession between the first and second border lines and adjoining each other along fifth and sixth borderlines, respectively, extending between and along adjacent ones of the transition projections, the first sub area being closest to the first long side and the third sub area being closest to the second long side, an imaginary straight line extending between two end points of each transition projection with a smallest angle $\alpha_n$, n=1, 2, 3 . . . in relation to the longitudinal center axis, the smallest angle $\alpha_n$ for at least a main part of the transition projections within the first sub area being essentially equal to a first angle $\alpha_1$, and the smallest angle $\alpha_n$ varying between the transition projections within the second sub area such that the smallest angle $\alpha_n$ for at least a main part of the transition projections within the second sub area is larger than said first angle $\alpha_1$ and increasing in a direction from the first long side to the second long side, wherein at least a main part of the second borderline is straight and essentially perpendicular to the longitudinal center axis of the heat transfer plate, and the smallest angle $\alpha_n$ for a first set of the transition projections within the third sub area is essentially equal to said first angle $\alpha_1$, the fifth borderline between the first and second sub areas being located, seen from the first long side of the heat transfer plate, just before the first two successive transition projections within the transition area that both are associated with a smallest angle $\alpha_n$ larger than said first angle $\alpha_1$, and the sixth borderline between the second and the third sub areas being located, seen from the fifth borderline, just before the first two successive transition projections within the transition area that both are associated with a smallest angle $\alpha_n$ equal to said first angle $\alpha_1$.

2. A heat transfer plate according to claim 1, wherein at least a main part of the transition projections of said first set of transition projections within the third sub area extends from the second borderline.

3. A heat transfer plate according to claim 2, wherein the smallest angle $\alpha_n$ for a second set of the transition projections within the third sub area is larger than said first angle $\alpha_1$, at least a main part of the transition projections of said second set extending from the first borderline.

4. A heat transfer plate according to claim 3, wherein each of at least a main part of the transition projections within the third sub area extending from the second borderline is connected to a respective one of the transition projections within the third sub area extending from the first borderline.

5. A heat transfer plate according to claim 1, wherein a shortest distance between the imaginary straight lines of two adjacent, along each other extending, transition projections within the third sub area is essentially constant within a main portion of the third sub area.

6. A heat transfer plate according to claim 1, wherein the heat transfer area borders on the third sub area of the transition area along 10-40% of the second border line.

7. A heat transfer plate according to claim 1, wherein a center portion of the first borderline is arched and convex as seen from the heat transfer area such that the center portion of the first borderline coincides with a contour of an imaginary oval, the first borderline deviating from the contour of the imaginary oval outside the center portion.

8. A heat transfer plate according to claim 7, wherein a second outer portion of the first borderline, which extends from the center portion of the first borderline towards the second long side of the heat transfer plate, extends towards the second borderline.

9. A heat transfer plate according to claim 8, wherein the second outer portion of the first borderline extends at a distance from, and essentially parallel to, a fourth borderline delimiting the distribution area.

10. A heat transfer plate according to claim 7, wherein the center portion of the first borderline occupies 40-90% of a width of the heat transfer plate.

11. A plate heat exchanger comprising a heat transfer plate according to claim 1.

* * * * *